US008201571B1

(12) United States Patent
Smith

(10) Patent No.: US 8,201,571 B1
(45) Date of Patent: Jun. 19, 2012

(54) BLIND ASSEMBLY

(76) Inventor: Marque Smith, West Monroe, LA (US)

( * ) Notice: Subject to any disclaimer, the term of this patent is extended or adjusted under 35 U.S.C. 154(b) by 150 days.

(21) Appl. No.: 12/660,073

(22) Filed: Feb. 19, 2010

(51) Int. Cl.
*E04H 15/04* (2006.01)

(52) U.S. Cl. ..... 135/90; 135/117; 135/901; 248/219.1

(58) Field of Classification Search ..... 135/90, 135/96, 117, 119, 901; 182/187–188, 116; 248/125.3, 243–245, 219, 218.4; 43/1
See application file for complete search history.

(56) References Cited

U.S. PATENT DOCUMENTS

| | | | | |
|---|---|---|---|---|
| 3,116,808 | A * | 1/1964 | Riley | 182/129 |
| 3,358,789 | A * | 12/1967 | Laun | 182/113 |
| 3,442,275 | A | 5/1969 | Ternes | |
| 4,951,696 | A * | 8/1990 | Jones, Sr. | 135/90 |
| 5,669,403 | A | 9/1997 | Belcher et al. | |
| 5,967,475 | A * | 10/1999 | Johnson | 248/217.4 |
| 6,243,979 | B1 | 6/2001 | Seats et al. | |
| 6,434,877 | B1 | 8/2002 | Shelton | |
| 6,588,440 | B2 | 7/2003 | Varnado | |
| 7,100,626 | B2 | 9/2006 | Livacich | |
| 7,182,091 | B2 | 2/2007 | Maddox | |
| 7,222,634 | B2 | 5/2007 | Hess et al. | |
| 7,246,630 | B1 | 7/2007 | Ransom et al. | |
| 7,556,052 | B2 | 7/2009 | Wright et al. | |
| 7,559,334 | B2 | 7/2009 | Cooper | |
| 7,841,355 | B2 * | 11/2010 | Livacich et al. | 135/120.3 |
| 7,861,987 | B2 * | 1/2011 | Gorsuch et al. | 248/219.1 |
| 2002/0078988 | A1 | 6/2002 | Valpredo | |
| 2003/0024559 | A1 * | 2/2003 | Fields | 135/90 |

* cited by examiner

*Primary Examiner* — Winnie Yip
(74) *Attorney, Agent, or Firm* — R. Keith Harrison

(57) ABSTRACT

A blind assembly includes a fastening assembly having substantially parallel frame receivers, an assembly frame carried by and disposed in substantially a common plane as the frame receivers of the fastening assembly and a blind panel carried by the assembly frame.

8 Claims, 12 Drawing Sheets

BLIND ASSEMBLY

FIELD

The disclosure generally relates to blinds used in concealing a game hunter or wildlife observer from animals. More particularly the disclosure relates to a blind assembly which is lightweight, simple in design, can be expeditiously attached to one or multiple trees or other supports for use and is adjustable in position, and further relates to a method of assembling a blind assembly.

BACKGROUND

Blinds are structures which are assembled or erected to conceal or partially conceal hunters or wildlife observers from animals in a natural setting for such purposes as game hunting or wildlife observation. Blinds range from relatively simple structures made of tree limbs, sticks, straw, leaves, rocks and/or other natural objects to commercial blinds having a prefabricated wood, metal or plastic support frame on which is provided camouflaged fabric, plastic, wood and/or metal panels defining a concealed or camouflaged enclosure. Concealment of a hunter or a wildlife observer in a blind emboldens game or wildlife to approach the blind without suspecting danger, thereby providing the hunter a chance to level an accurate shot at the game or the observer to view the wildlife at close range.

Both natural and conventional prefabricated blinds may have a number of drawbacks. With regard to natural blinds, difficulty may be encountered in finding and gathering limbs, sticks, straw, leaves, rocks and other natural objects which are suitable for construction of the blind, particularly under circumstances in which those objects are scarce in the area in which game hunting or wildlife observation is to be carried out. Moreover, the blind may be excessively confining and therefore, may restrict or hinder a hunter's or wildlife observer's freedom of movement and visibility. Prefabricated blinds may be bulky, heavy and difficult to carry or transport when disassembled and may also be difficult and time-consuming to assemble or erect at a site of use. Furthermore, the position of both types of blinds may not be selectively adjustable to the preferences of the user.

Accordingly, a blind assembly which is lightweight, simple in design, can be expeditiously attached to one or multiple trees or other supports for use and is selectively adjustable in position to the preferences of a user is needed.

SUMMARY

The disclosure is generally directed to a blind assembly which is lightweight, simple in design, can be expeditiously attached to one or multiple trees or other supports for use and is selectively adjustable in position to the preferences of a user. An illustrative embodiment of the blind assembly includes a fastening assembly having substantially parallel frame receivers, an assembly frame carried by and disposed in substantially a common plane as the frame receivers of the fastening assembly and a blind panel carried by the assembly frame.

In some embodiments, the blind assembly may include a fastening assembly having a fastening assembly strap, a pair of strap brackets with a pair of bracket plates and a pair of bracket loops carried by the pair of bracket plates and receiving the fastening assembly strap and a pair of substantially elongated, parallel, tubular frame receivers having a pair of receiver openings, respectively, carried by the pair of bracket plates of the pair of strap brackets, respectively, and an assembly frame inserted in the frame receivers of the fastening assembly The fastening assembly strap of the fastening assembly may be disposed in a first plane and the frame receivers and the assembly frame may be disposed in a second plane substantially parallel to the first plane. A blind panel is carried by the assembly frame. A blind interior is defined by the blind panel and may be adjustable in size by sliding the assembly frame through the frame receivers of the fastening assembly.

In some embodiments, the blind assembly may include a fastening assembly having a pair of substantially elongated, parallel, tubular frame receivers having a pair of receiver openings, respectively, and a pair of fastening screws carried by the pair of frame receivers, respectively; and an assembly frame inserted in the frame receivers of the fastening assembly. The pair of frame receivers, the pair of fastening screws and the assembly frame may be disposed in substantially a common plane. A blind panel is carried by the assembly frame. A blind interior is defined by the blind panel and may be adjustable in size by sliding the assembly frame through the frame receivers of the fastening assembly.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1A:
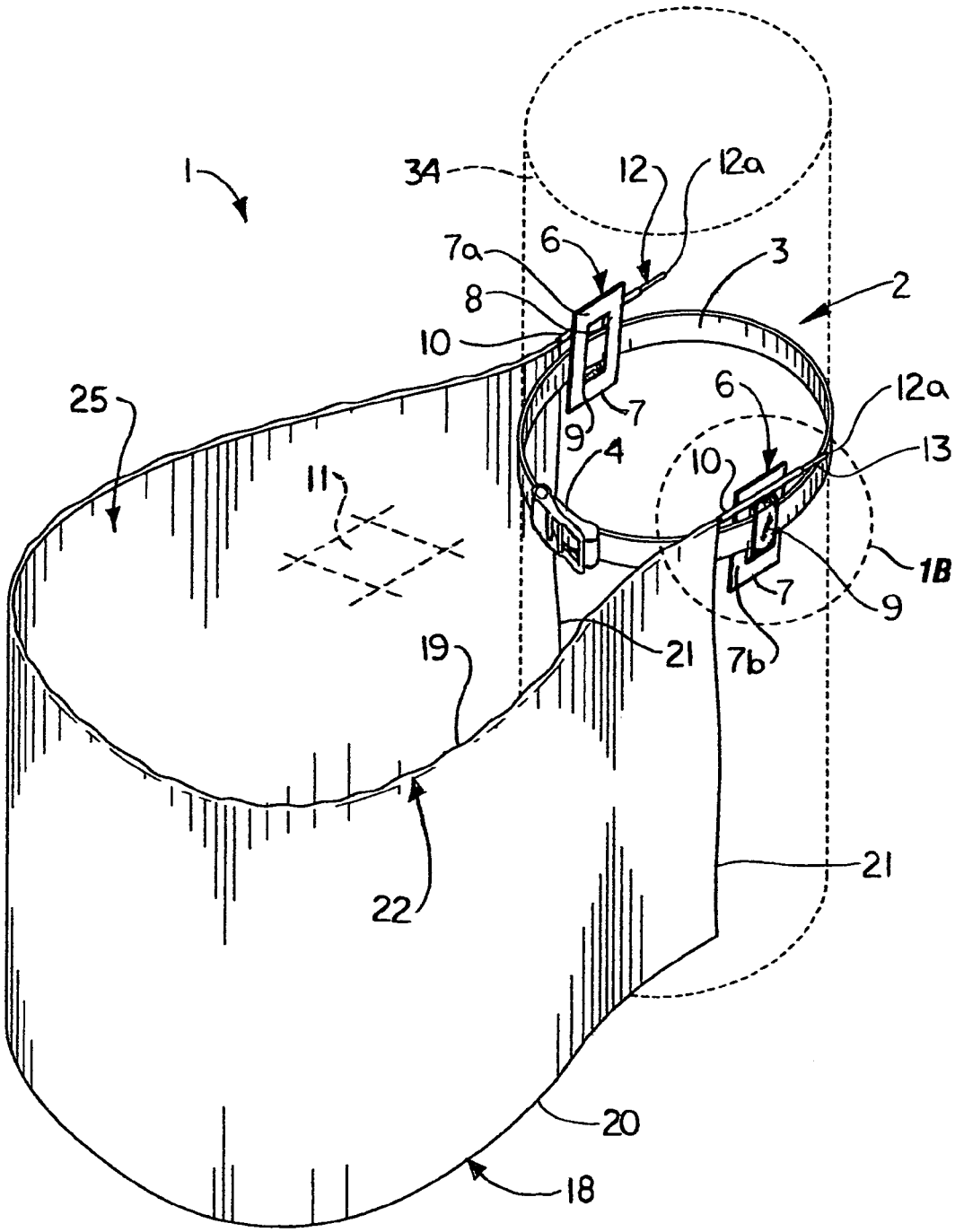
FIG. 1A is a perspective view of an illustrative embodiment of the blind assembly, attached to a support (illustrated in phantom)

Referring initially to FIGS. 1A, 1B and 8-10A of the drawings, an illustrative embodiment of the blind assembly is generally indicated by reference numeral 1 in FIG. 1A. The blind assembly 1 includes a fastening assembly 2 which is adapted for fastening to a vertical support 34 (illustrated in phantom) such as a tree, for example and without limitation, as will be hereinafter described. In some embodiments, the fastening assembly 2 may include a generally elongated fastening assembly strap 3 the length of which is sufficient to extend around the support 34. In some embodiments the fastening assembly strap 3 may have a length of about 5 feet, although the assembly strap 3 may be longer or shorter depending on the desired application of the blind assembly 1. The fastening assembly strap 3 of the fastening assembly 2 may be nylon, leather and/or other suitable strong, durable material. A ratchet mechanism 4, which may have a conventional design, may be provided on the fastening assembly strap 3 to selectively adjust the circumference of the fastening assembly strap 3 around the support 34 as is known by those skilled in the art.

A pair of strap brackets 6 may be provided on the fastening assembly strap 3. Each strap bracket 6 may be attached to the fastening assembly strap 3 according to any suitable technique which is known by those skilled in the art. In some embodiments, each strap bracket 6 may include a bracket plate 7 which may have a generally elongated, rectangular shape. In some embodiments, the bracket plate 7 may have a length of about 3 inches and a width of about 1.5 inches, although these dimensions may vary in different embodiments. The bracket plate 7 may have an inner plate surface 7*a* (FIG. 1A) and an outer plate surface 7*b*. A bracket loop 9 may be extruded from a bracket slot 8 provided in the bracket slot 7 and extends beyond the plane of the outer plate surface 7*b*. The fastening assembly strap 3 may be extended through the bracket loop 9 of each strap bracket 6 to slidably mount the strap bracket 6 to the fastening assembly strap 3. The bracket plate 7 and bracket loop 9 of each strap bracket 6 may be a metal such as steel or aluminum or may be a composite material or any other type of material which is consistent with the functional requirements of the strap brackets 6.

Figure 8:
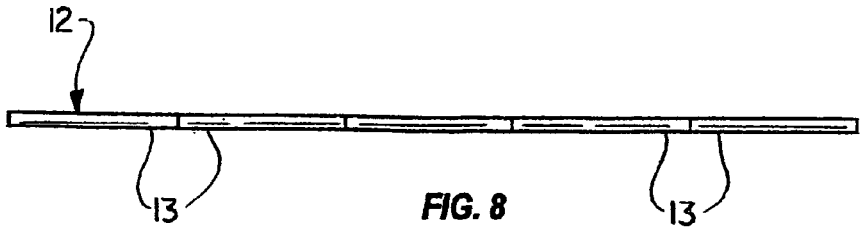
FIG. 8 is a side view of an extended segmented assembly frame which is suitable for implementation of an illustrative embodiment of the blind assembly.
Figure 9:
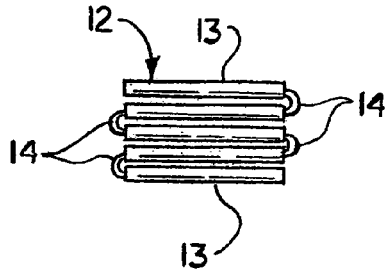
FIG. 9 is a side view of the segmented assembly frame disposed in a folded configuration.

An elongated assembly frame 12 having assembly frame ends 12*a* is supported by the fastening assembly 2 as will be hereinafter described. As illustrated in FIGS. 8 and 9, in some embodiments the assembly frame 12 may include multiple, adjacent, interconnected assembly frame segments 13 which are disposed in end-to-end relationship with respect to each other. An assembly frame cord 14 (FIG. 9), which may be elastic or resilient, may extend through the assembly frame segments 13 and attach the adjacent assembly frame segments 13 to each other. Accordingly, the assembly frame 12 can be selectively deployed in the straight configuration illustrated in FIG. 8; the completely-folded storage configuration illustrated in FIG. 9; or the partially-folded functional configuration illustrated in FIG. 10A. While the assembly frame 12 illustrated in FIGS. 8 and 9 has five assembly frame segments 13, the assembly frame 12 may have a greater or lesser number of the assembly frame segments 13 depending on the desired application of the blind assembly 1.

The assembly frame 12 may be secured to the strap brackets 6 of the fastening assembly 2 according to any suitable technique which is known by those skilled in the art. In some embodiments, a frame receiver 10 may be provided on the bracket plate 7 of each strap bracket 6. The frame receiver 10 may have a generally elongated, tubular shape with a receiver opening 10*a* (FIG. 1B) extending there through. The frame receiver 10 may be square tubing, round tubing or any other shape. In some embodiments, the frame receiver 10 may be welded and/or otherwise fastened to or may be fabricated in one piece with the outer plate surface 7*b* of the bracket plate 7. Each assembly frame end 12*a* of the assembly frame 12 may be friction-fitted into the receiver opening 10*a* (FIG. 1B) of the frame receiver 10 on the corresponding strap bracket 6 to detachably secure the assembly frame 12 to the strap brackets 6.

Figure 1B:
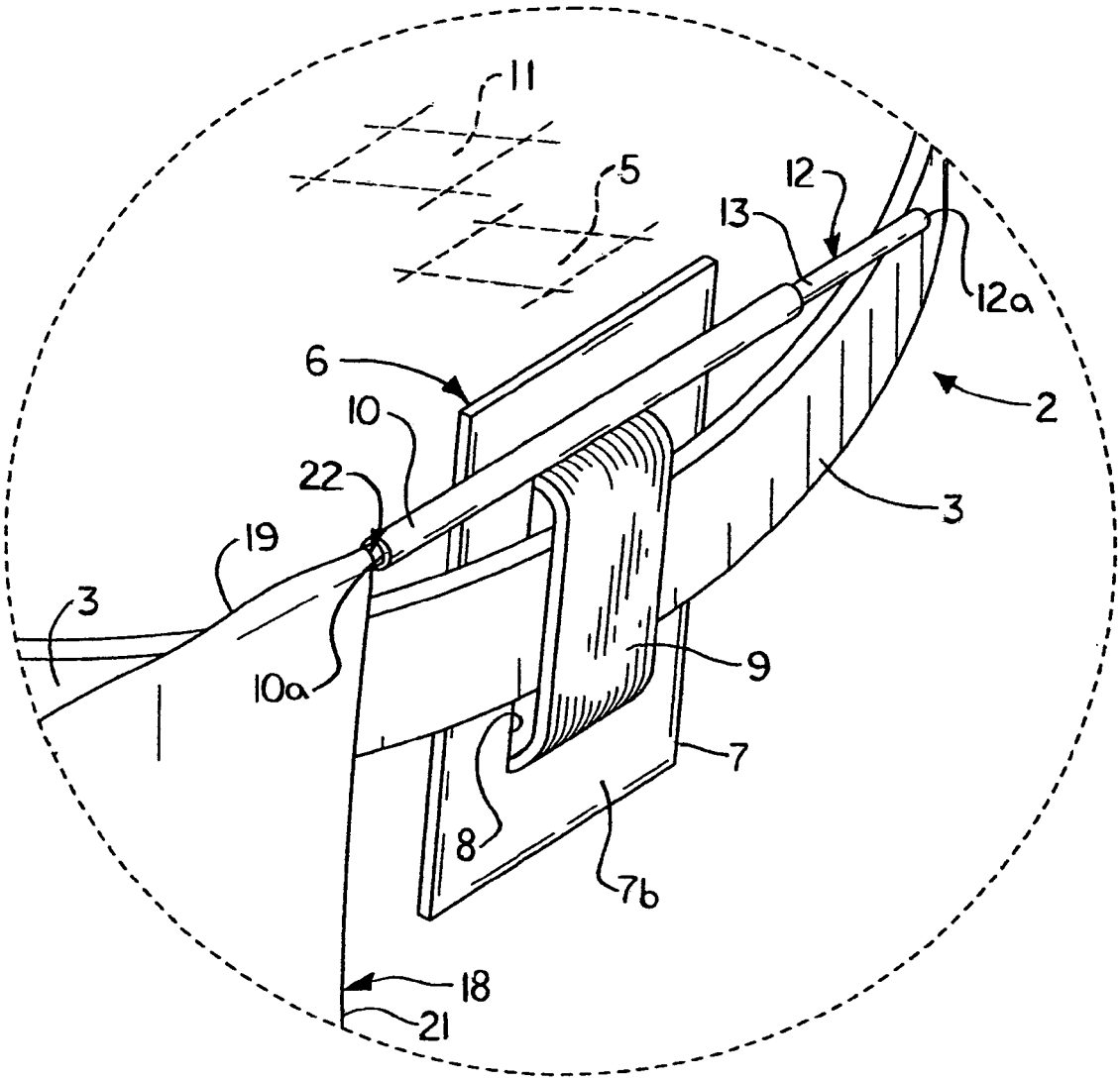
FIG. 1B is an enlarged sectional view, taken along section line 1B in FIG. 1A.

As illustrated in FIG. 1A, the frame receivers 10 of the respective strap brackets 6 may be oriented in substantially parallel relationship with respect to each other and in substantially the same plane 11. The frame receivers 10 and the assembly frame 12 may also be disposed in substantially the same plane 11. As illustrated in FIG. 1B, the fastening assembly strap 3 of the fastening assembly 2 may be disposed in a plane 5 which is substantially parallel to the plane 11 in which the frame receivers 10 and the assembly frame 12 are disposed.

Figure 10:
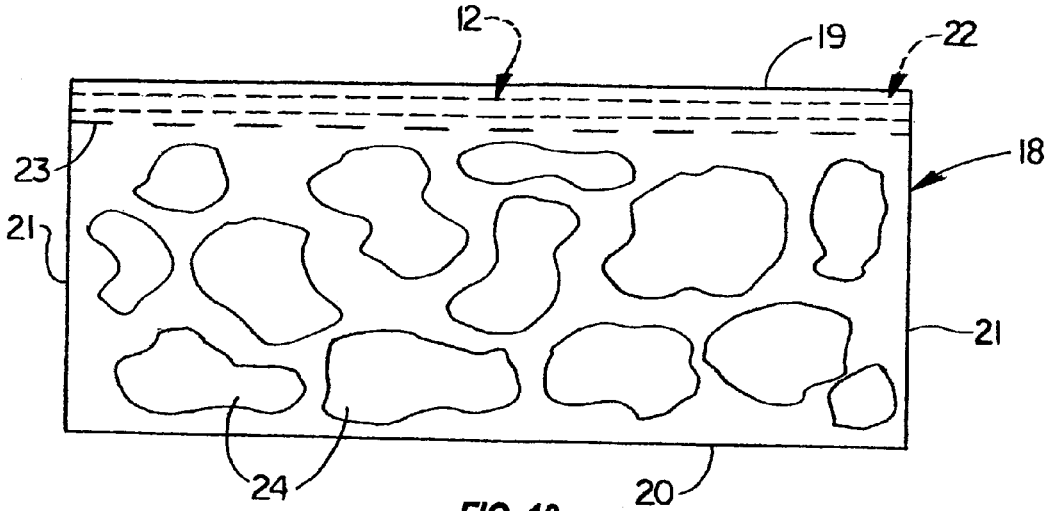
FIG. 10 is a front view of a blind panel which is suitable for implementation of an illustrative embodiment of the blind assembly.
Figure 10A:
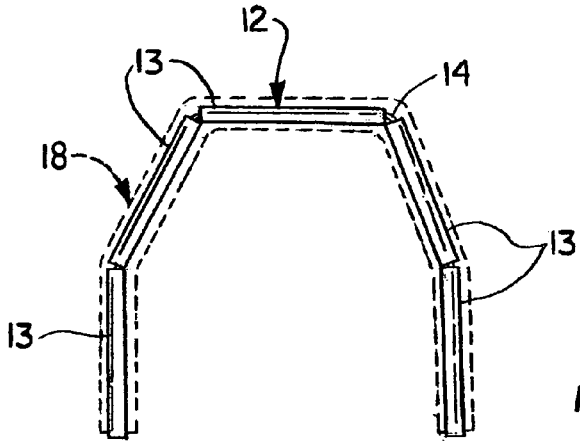
FIG. 10A is a top view of the segmented assembly frame disposed in a partially-folded functional configuration, with a blind panel (illustrated in phantom) deployed on the assembly frame.

A blind panel 18 is provided on the assembly frame 12 of the blind assembly 1. The assembly frame 12 may support the blind panel 18 in a cantilever configuration on the support 34. The blind panel 18 may be cotton, polyester, nylon and/or any other suitable flexible fabric material. In some embodiments, the blind panel 18 may have a generally elongated, rectangular shape with an upper panel edge 19; a lower panel edge 20; and side panel edges 21 extending between the upper panel edge 19 and the lower panel edge 20. As illustrated in FIG. 10, a frame loop 22 may be sewn in the upper panel edge 19 of the blind panel 18 via stitching 23 or may be otherwise provided in the blind panel 18. As illustrated in phantom in FIG. 10, the frame loop 22 may be sized and configured to receive the assembly frame 12. In some embodiments, a camouflage pattern 24 of selected design may be provided on the blind panel 18 according to the knowledge of those skilled in the art. As illustrated in FIG. 1A, when the blind assembly 1 is deployed on a support 34, as will be hereinafter further described, a blind interior 25 is defined by and between the blind panel 18 and the support 34.

Figure 6:
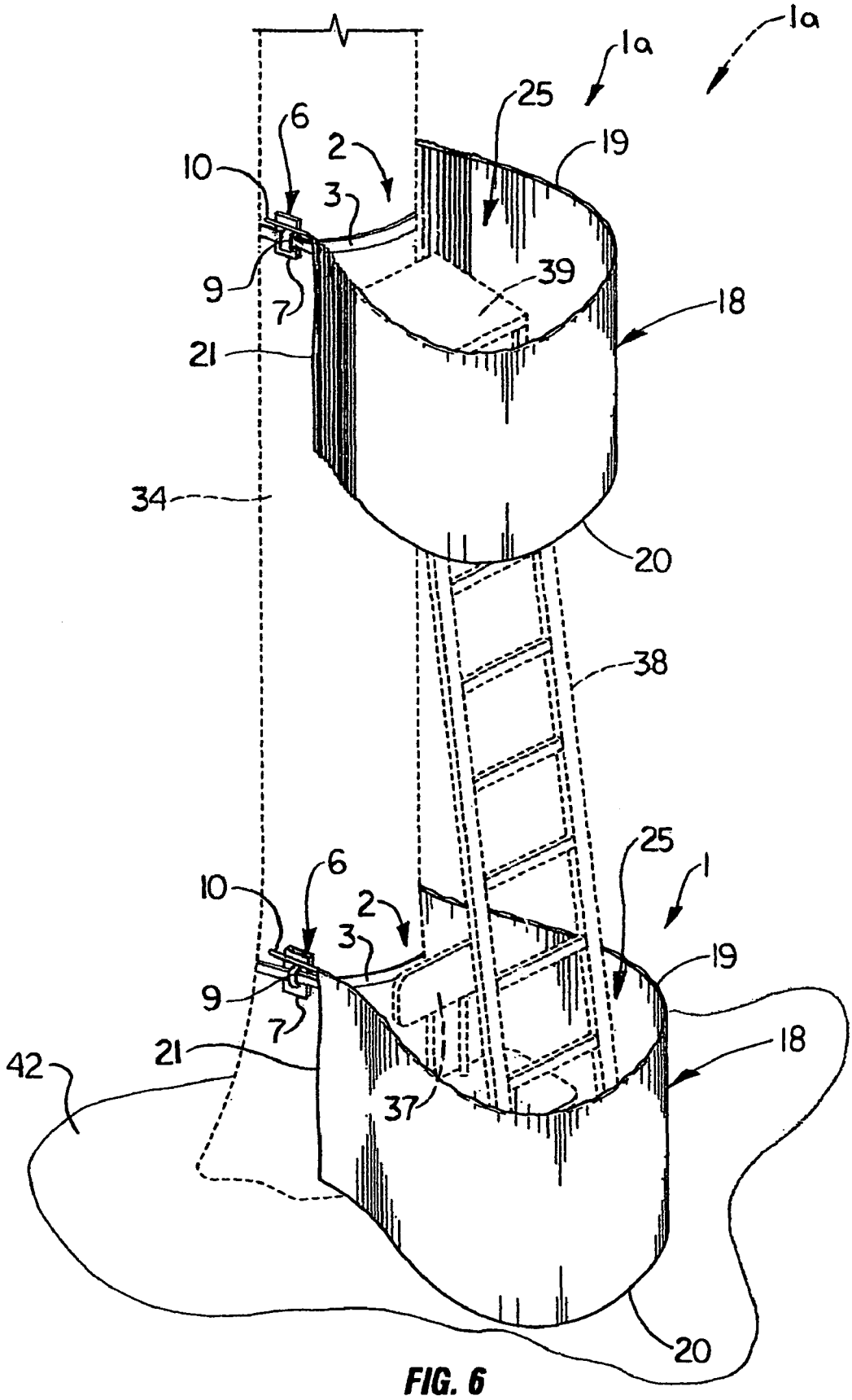
FIG. 6 is a perspective view of a pair of the blinds illustrated in FIG. 1, fastened to a single support (illustrated in phantom)

Referring next to FIGS. 1A, 1B and 6 of the drawings, in typical application the blind assembly 1 is fastened to a vertical support 34 such as a tree, for example and without limitation, for the purpose of concealing a hunter or a wildlife observer (not illustrated) from game or wildlife (not illustrated) during game hunting or wildlife observation. The fastening assembly 2, the assembly frame 12 and the blind panel 18 of the blind assembly 1 are lightweight and therefore, may be easily carried from a vehicle (not illustrated) or other location to the support 34. The fastening assembly 2 is fastened to the support 34 typically by extending and fastening the fastening assembly strap 3 around the support 34. The ratchet mechanism 4 may be operated to tighten the assembly strap 3 around the support 34. Therefore, the inner plate surfaces 7*a* on the bracket plates 7 of the respective strap brackets 6 engage opposite sides of the support 34. The blind panel 18 may be placed on the assembly frame 12 by extending the assembly frame 12 through the frame loop 22 of the blind panel frame 18. The assembly frame 12 may be configured in a generally curved or looped shape and then attached to the fastening assembly 2 by friction-fitting the assembly frame ends 12*a* of the assembly frame 12 into the frame receivers 10 of the respective strap brackets 6. The size of the blind interior 25 may be selectively adjusted by sliding the assembly frame 12 in either direction through each frame receiver 10. The height of the blind panel 18 can be selectively adjusted to the preferences of the user by pivoting the strap brackets 6 with respect to the support 34.

As illustrated in FIG. 6, in some applications a blind assembly 1 can be assembled on the support 34 generally at or near the ground 42. A chair 37 may be placed on the ground 42 inside the blind interior 25 of the blind assembly 1. A hunter (not illustrated) or a wildlife observer (not illustrated) sits in the chair 37 and views the area outside the blind assembly 1, such as by peering over the upper panel edge 19 of the blind panel 18, in an effort to spot game or wildlife. The blind panel 18 substantially conceals the hunter or wildlife observer from the game or wildlife and thus, the game or wildlife may be emboldened to approach the blind assembly 1. Therefore, the game may come into sufficient proximity to the hunter for the hunter to level an accurate shot at the game. Alternatively, the wildlife may come into sufficient proximity to the wildlife observer for the observer to observe and/or record the wildlife at close range. The blind assembly 1 can be selectively disassembled, as desired, by removing the assembly frame 12 from the frame receivers 10 of the respective strap brackets 6 and unfastening the fastening assembly strap 3 of the fastening assembly 2 from around the support 34. The blind panel 18 may be removed from the assembly frame 12, as desired.

As further illustrated in FIG. 6, in some applications a first blind assembly 1 is assembled on the support 34 generally at or near the ground 42. A chair 37 may be placed on the ground 42 in the blind interior 25 of the first blind assembly 1. A second blind assembly 1*a* is assembled on the support 34 at a position which is elevated with respect to the first blind assembly 1. A leaning stand 38 (illustrated in phantom), which may be conventional, is placed on the ground 42 inside the blind interior 25 of the first blind assembly 1. A leaning stand platform 39 provided on the leaning stand 38 leans against the support 34 in the blind interior 25 of the second blind assembly 1*a*. Accordingly, a first user (not illustrated) can sit on the chair 37 in the blind interior 25 of the first blind assembly 1 while a second user (not illustrated) can sit on the elevated leaning stand platform 39 in the blind interior 25 of the second blind assembly 1*a* typically for game hunting or wildlife observation purposes.

Figure 2A:
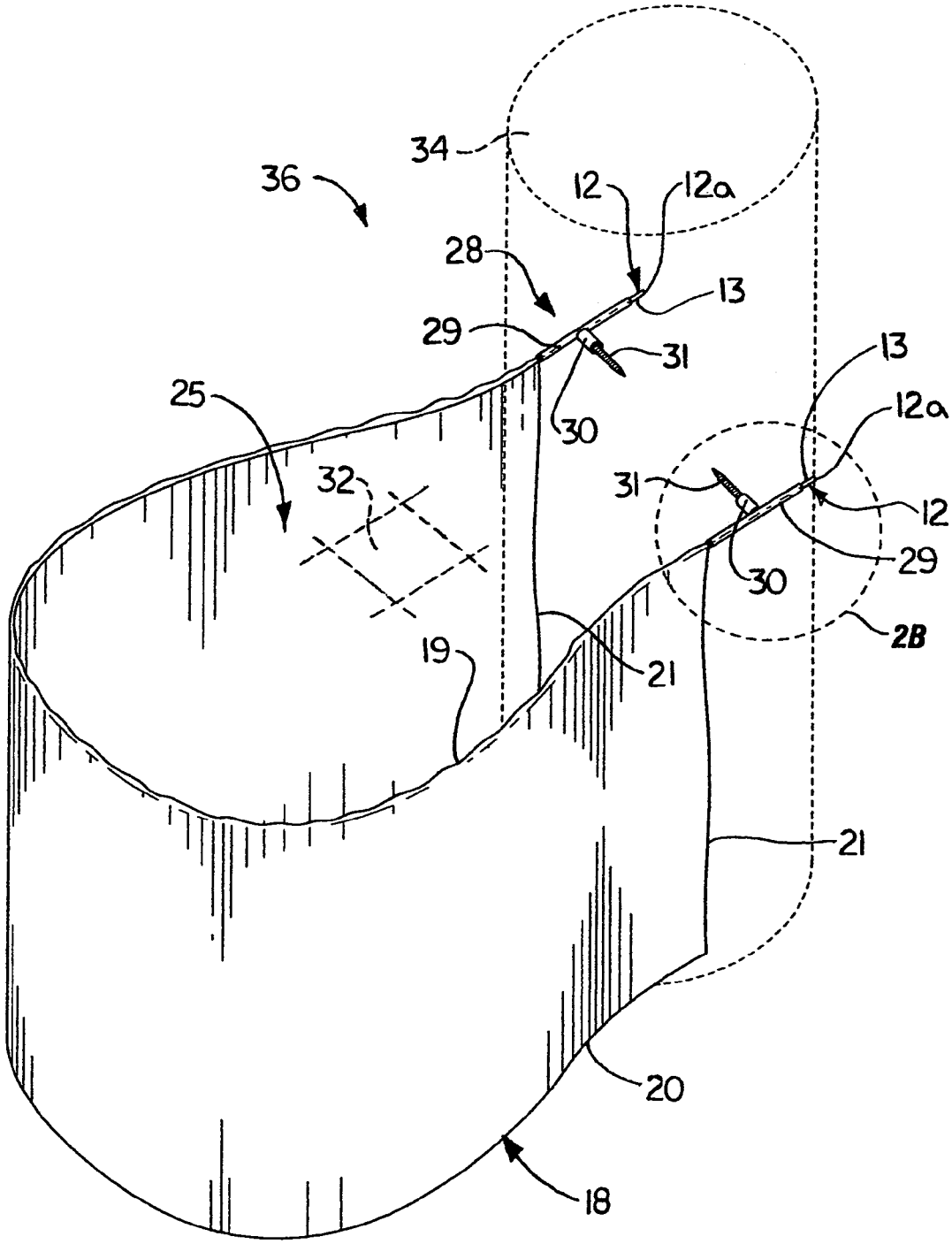
FIG. 2A is a perspective view of an alternative illustrative embodiment of the blind assembly, attached to a support (illustrated in phantom)
Figure 2B:
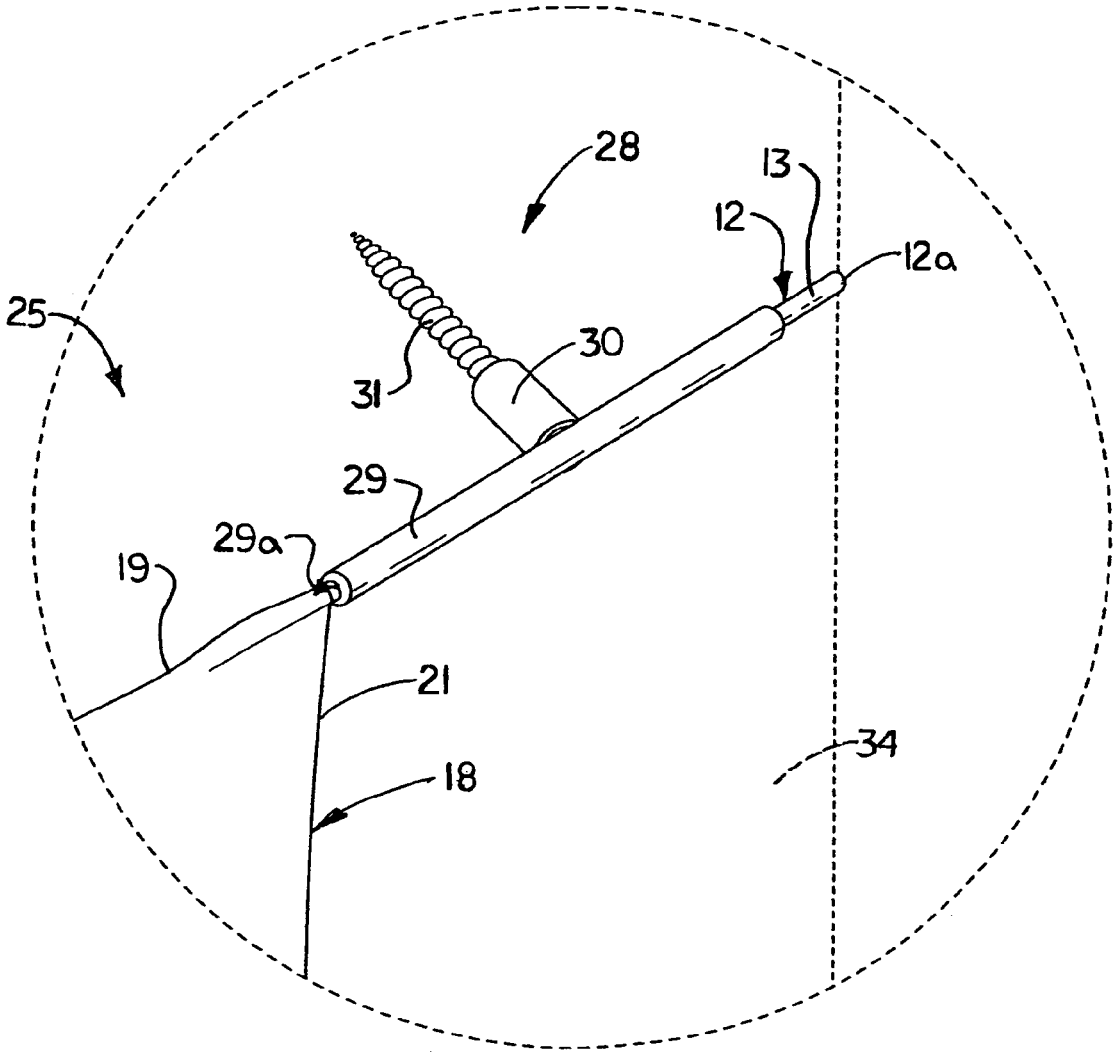
FIG. 2B is an enlarged sectional view, taken along section line 2B in FIG. 2A.

Referring next to FIGS. 2A-5B of the drawings, an alternative illustrative embodiment of the blind assembly is generally indicated by reference numeral 36. The blind assembly 36 includes a fastening assembly 28 which is adapted for fastening to a vertical support 34 (illustrated in phantom) such as a tree, for example and without limitation, as will be hereinafter described. The fastening assembly 28 may include a pair of frame receivers 29 each of which is adapted to receive a corresponding assembly frame end 12*a* of the assembly frame 12. Each frame receiver 29 of the fastening assembly 28 may have a generally elongated, tubular shape with a receiver opening 29*a* (FIG. 2B) extending there through. Each frame receiver 29 may be square tubing, round tubing or any other shape. As illustrated in FIG. 2A, the frame receivers 29 of the fastening assembly 28 may be oriented in substantially parallel relationship with respect to each other.

A fastening screw 31 may extend from each frame receiver 29 of the fastening assembly 28. In some embodiments, the fastening screw 31 may extend from each frame receiver 29 at substantially the midpoint of the frame receiver 29. A spacer 30 may be provided on the fastening screw 31. Therefore, as illustrated in FIGS. 2A, 2B and 4-5B, each fastening screw 31 of the fastening assembly 28 can be threaded into the support 34 to secure the blind assemblies 36 to the respective sides of the support 34. The spacers 30 of the fastening assembly 28 may maintain each frame receiver 29 of the fastening assembly 28 in spaced-apart relationship with respect to the support 34. As illustrated in FIG. 2A, the assembly frame 12 and the frame receivers 29 and the fastening screws 31 of the fastening assembly 28 may be disposed in substantially the same plane 32.

Figure 3:
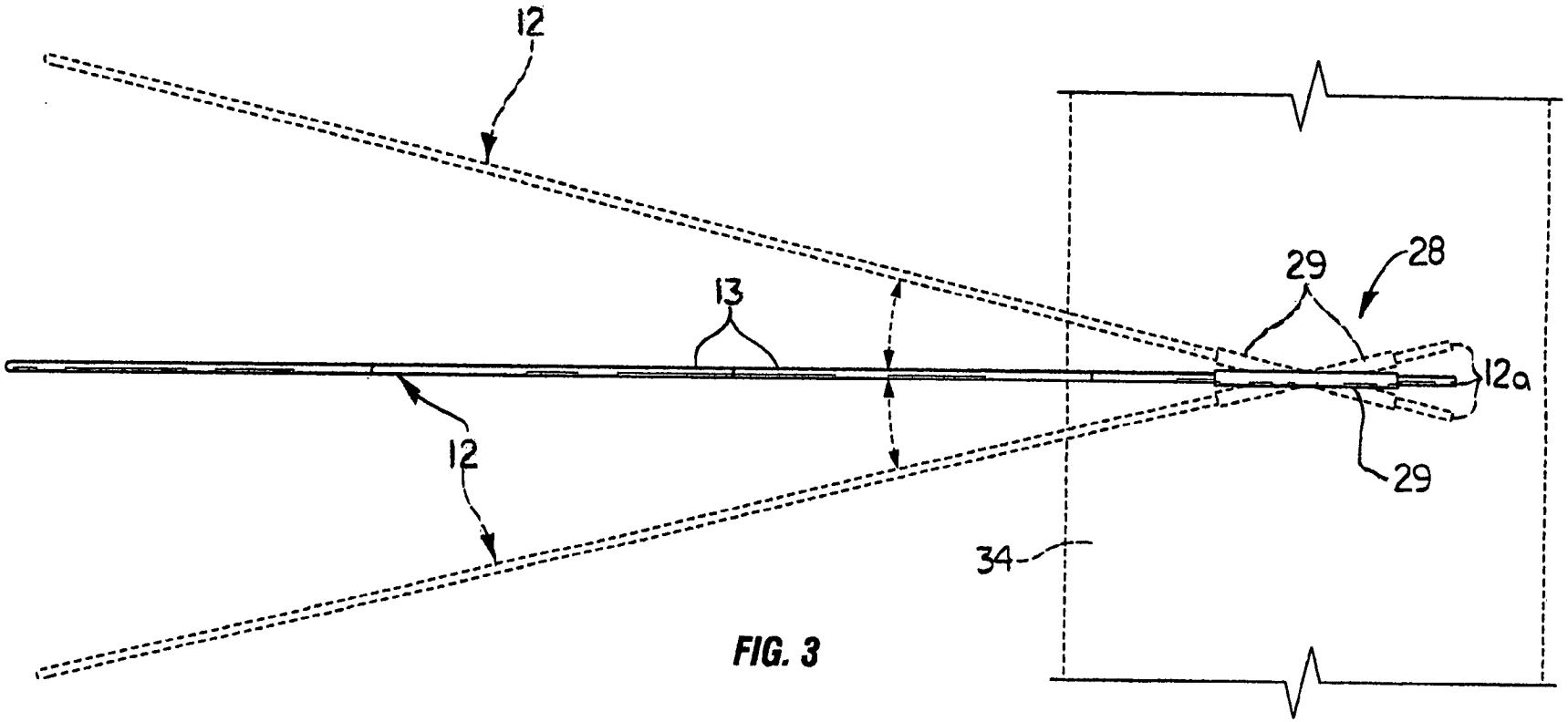
FIG. 3 is a side view of a fastening assembly of the illustrative embodiment of the blind assembly illustrated in FIG. 2A, more particularly illustrating angular adjustment capability of the blind assembly.
Figure 4:
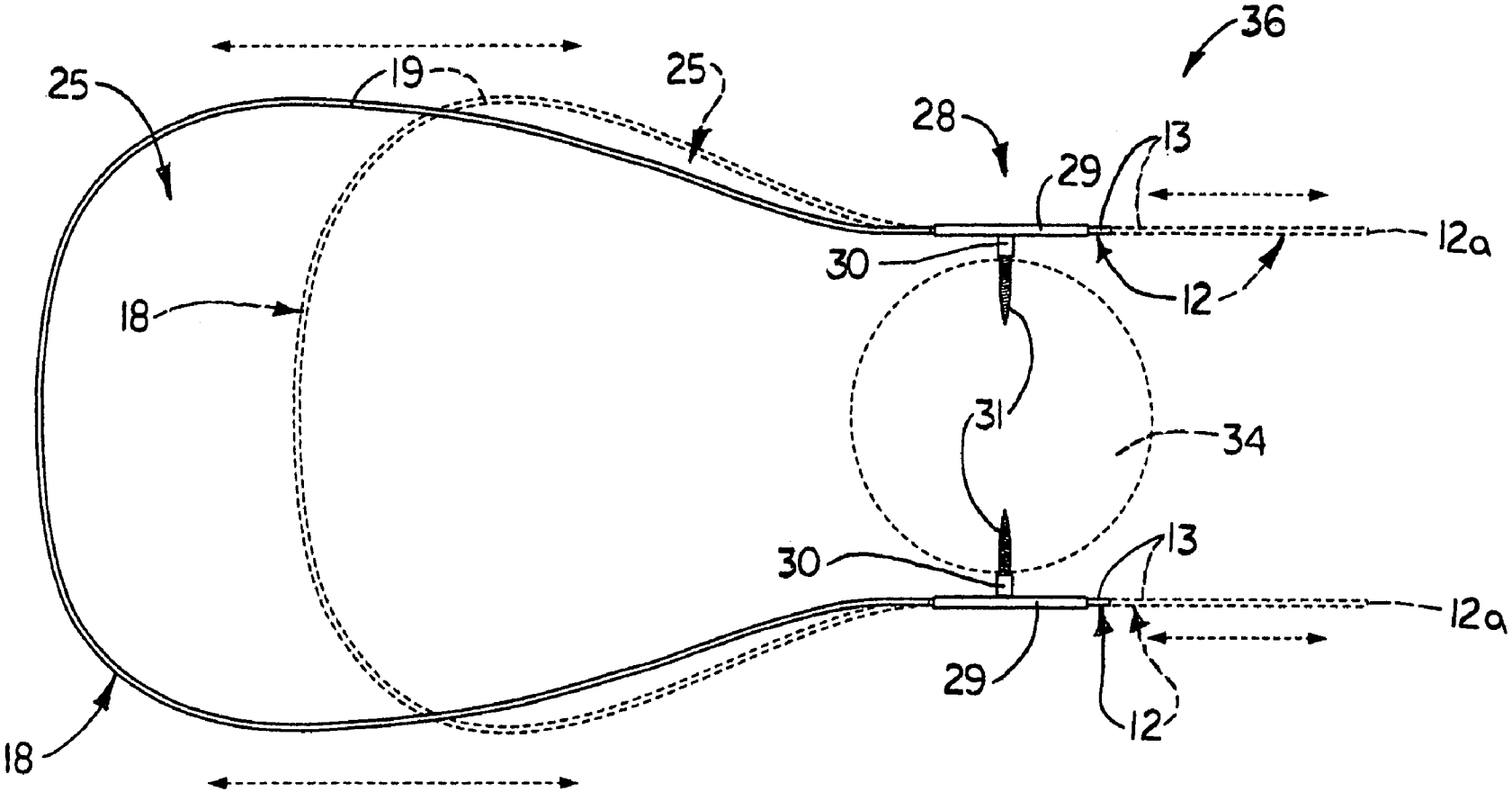
FIG. 4 is a top view of the illustrative embodiment of the blind assembly illustrated in FIG. 2A, more particularly illustrating adjustment capability of the blind interior of the blind assembly.

Referring next to FIGS. 2A-5B and 7 of the drawings, in typical application the blind assembly 36 is fastened to a vertical support 34 (illustrated in phantom) such as a tree, for example and without limitation, for the purpose of concealing a hunter or a wildlife observer (not illustrated) from game or wildlife during game hunting or wildlife observation. The fastening assembly 28, the assembly frame 12 and the blind panel 18 of the blind assembly 36 are lightweight and therefore, may be easily carried from a vehicle (not illustrated) or other location to the support 34. The fastening assembly 28 is fastened to the support 34 typically by threading the fastening screws 31 of the fastening assembly 28 into the support 34. This may be carried out by pressing the sharp or tapered end of the fastening screw 31 against the support 34 while rotating the frame receiver 29. The blind panel 18 may be placed on the assembly frame 12 by extending the assembly frame 12 through the frame loop 22 of the blind panel frame 18. The assembly frame 12 may be configured in a generally curved or looped shape and then attached to the fastening assembly 28 by friction-fitting the assembly frame ends 12*a* of the assembly frame 12 into the respective frame receivers 29 of the fastening assembly 28. As illustrated in FIG. 4, the size of the blind interior 25 may be selectively adjusted by sliding the assembly frame 12 in either direction through the corresponding frame receiver 29 of the fastening assembly 28. As illustrated in FIG. 3, the angle of the assembly frame 12 and thus, the height of the blind panel 18 which is supported thereon can be selectively adjusted to the preferences of the user by pivoting the fastening screws 31 and the frame receivers 29 of the fastening assembly 28 with respect to the support 34.

Figure 5A:
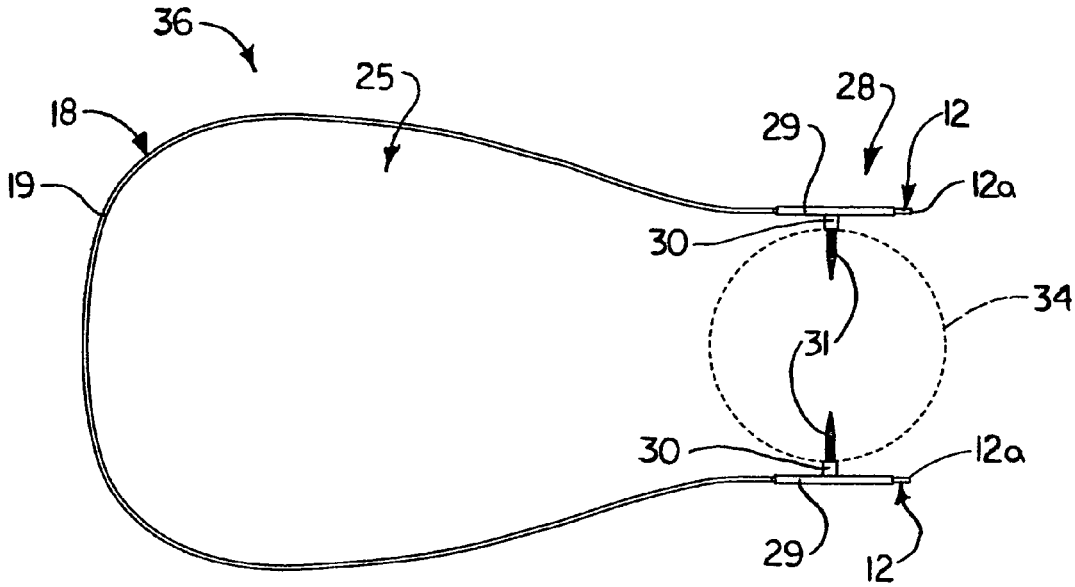
FIG. 5A is a top view of the illustrative embodiment of the blind assembly illustrated in FIG. 2A, fastened to a single support (illustrated in phantom)
Figure 5B:
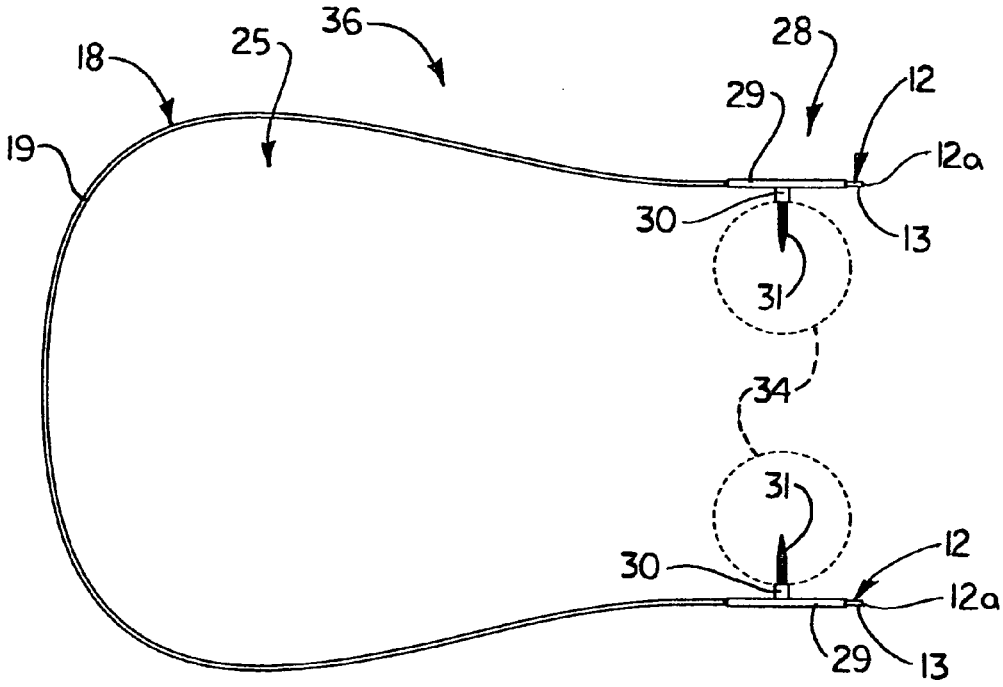
FIG. 5B is a top view of the illustrative embodiment of the blind assembly illustrated in FIG. 2A, fastened to a pair of adjacent supports (illustrated in phantom)

As illustrated in FIG. 5A, it will be appreciated by those skilled in the art that under circumstances in which the width or diameter of a single support 34 is sufficient to provide a blind assembly 1 with a blind interior 25 having the desired width, the fastening assembly 28 can be attached to opposite sides of the single support 34. However, in some circumstances it may be difficult to find a support 34 having a width or diameter which is sufficient to provide a blind assembly 1 with a blind interior 25 having the desired width in the game hunting or wildlife observation area. Therefore, as illustrated in FIG. 5B, under circumstances in which the combined diameters or widths of a pair of adjacent supports 34 are sufficient to provide a blind assembly 1 with a blind interior 25 having the desired width, the fastening assembly 28 can be attached to opposite sides of the adjacent supports 34.

Figure 7:
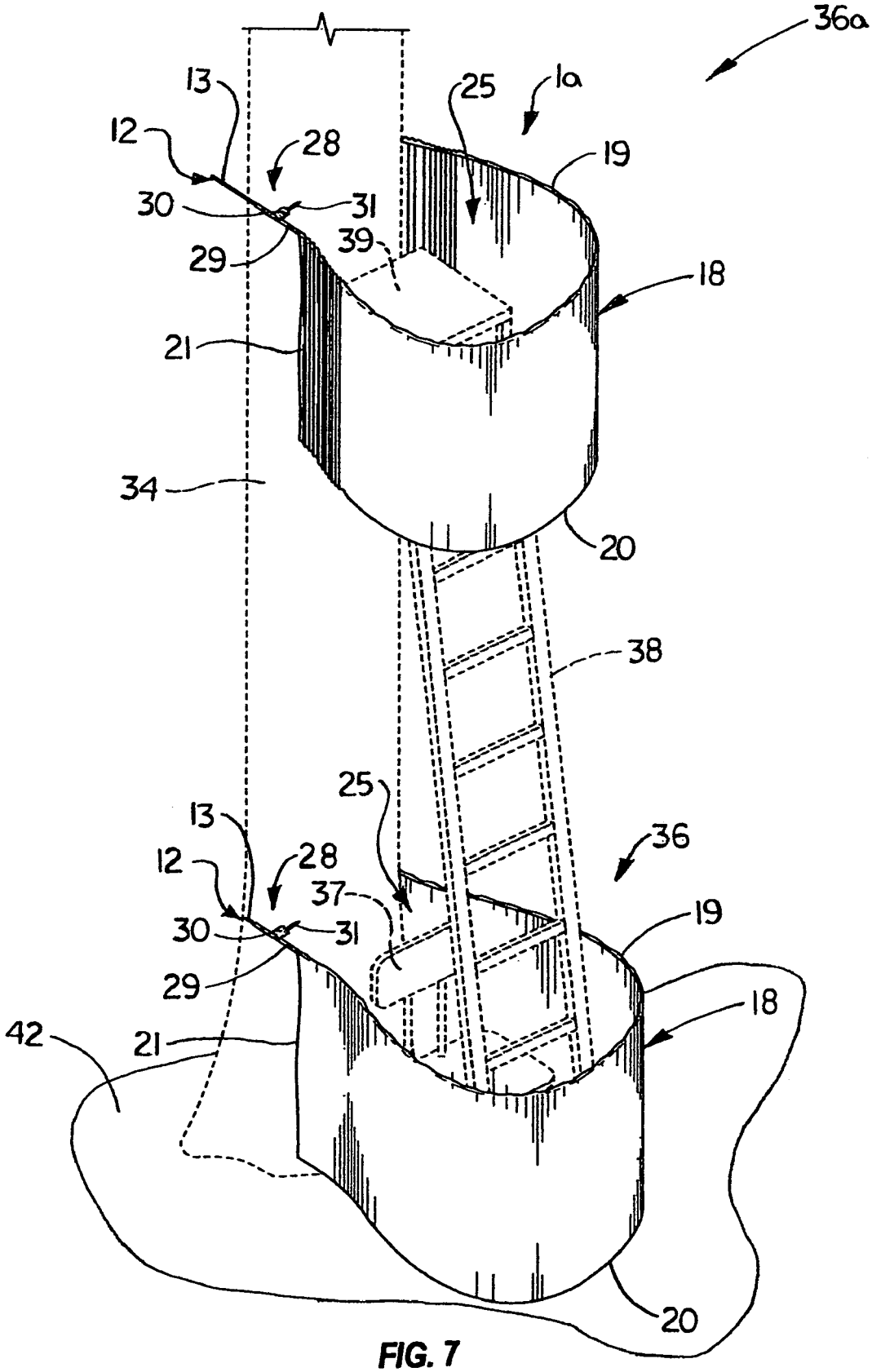
FIG. 7 is a perspective view of a pair of the blinds illustrated in FIG. 2A, fastened to a single support (illustrated in phantom)

As illustrated in FIG. 7, in some applications a blind assembly 36 can be assembled on the support 34 generally at or near the ground 42. A chair 37 may be placed on the ground 42 inside the blind interior 25 of the blind assembly 36. A hunter (not illustrated) or a wildlife observer (not illustrated) sits in the chair 37 and views the area outside the blind assembly 36, such as by peering over the upper panel edge 19 of the blind panel 18, in an effort to spot game or wildlife. The blind panel 18 substantially conceals the hunter or wildlife observer from the game or wildlife and thus, the game or wildlife may be emboldened to approach the blind assembly 36. Therefore, the game may come into sufficient proximity to the concealed hunter for the hunter to level an accurate shot at the game. Alternatively, the wildlife may come into sufficient proximity to the concealed wildlife observer for the observer to observe and/or record the wildlife at close range. The blind assembly 36 can be selectively disassembled, as desired, by removing the assembly frame 12 from the frame receivers 29 of the fastening assembly 28 and unthreading each fastening screw 31 of the fastening assembly 28 from the support 34. The blind panel 18 may be removed from the assembly frame 12, as desired.

As further illustrated in FIG. 7, in some applications a first blind assembly 36 is assembled on the support 34 generally at or near the ground 42. A chair 37 may be placed on the ground 42 in the blind interior 25 of the first blind assembly 36. A second blind assembly 36*a* is assembled on the support 34 at a position which is elevated with respect to the first blind assembly 36. A leaning stand 38 (illustrated in phantom) which may be conventional is placed on the ground 42 inside the blind interior 25 of the first blind assembly 36. A leaning stand platform 39 provided on the leaning stand 38 leans against the support 34 in the blind interior 25 of the second blind assembly 36*a*. Accordingly, a first user (not illustrated) can sit on the chair 37 in the blind interior 25 of the first blind assembly 36 while a second user (not illustrated) can sit on the elevated leaning stand platform 39 in the blind interior 25 of the second blind assembly 36*a*.

Figure 11:
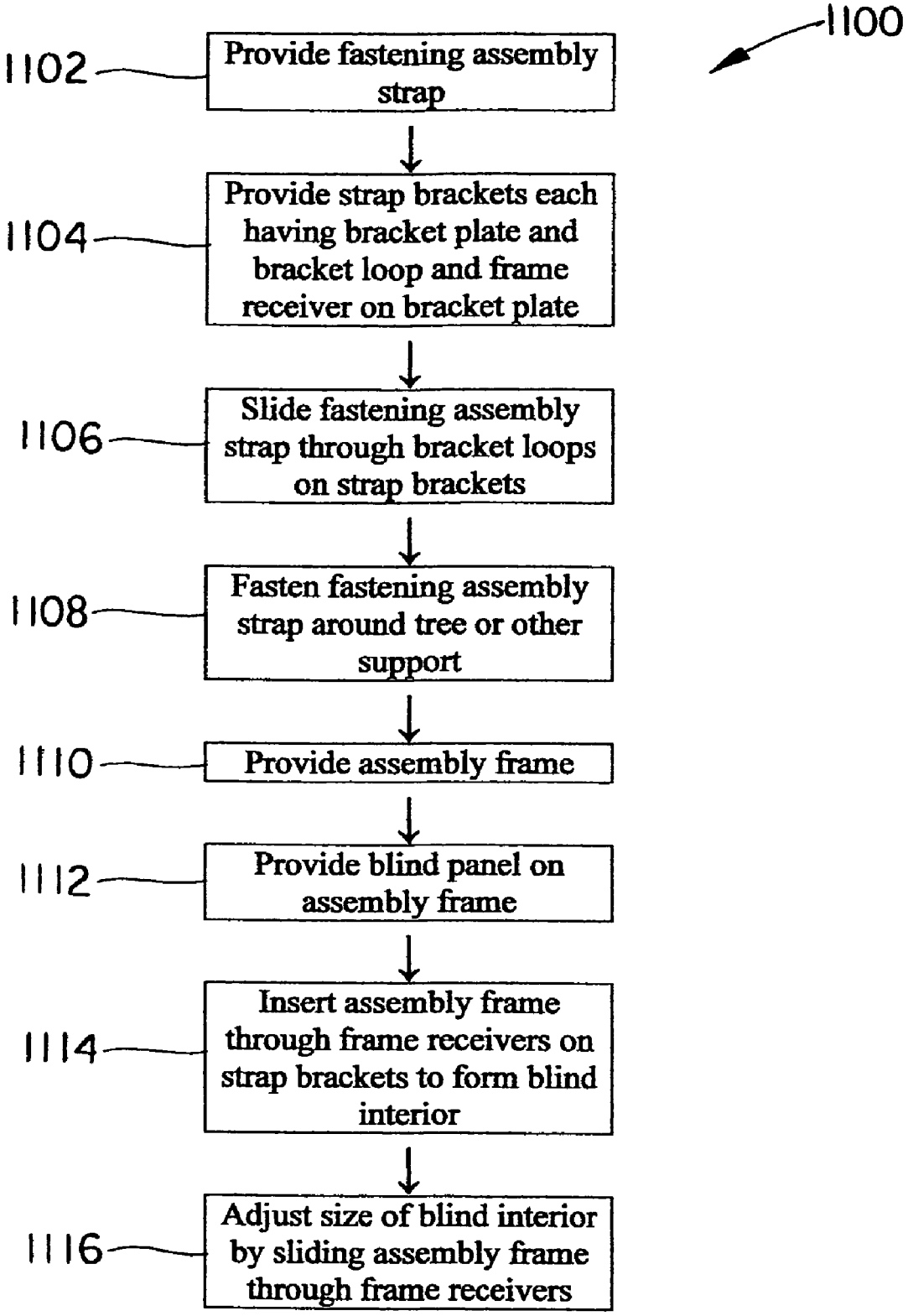
FIG. 11 is a flow diagram of an illustrative embodiment of a method of assembling a blind assembly.

Referring next to FIG. 11 of the drawings, a flow diagram 1100 of an illustrative embodiment of a method of assembling a blind assembly is illustrated. In block 1102, a fastening assembly strap is provided. In block 1104, strap brackets each having a bracket plate and a bracket loop and a frame receiver on the bracket plate are provided. In block 1106, the fastening assembly is slid through the bracket loops on the strap brackets. In block 1108, the fastening assembly strap is fastened around a tree or other support. In block 1110, an assembly frame is provided. In block 1112, a blind panel is provided on the assembly frame. In block 1114, the assembly frame is inserted through the frame receivers on the strap brackets to form a blind interior. In block 1116, the size of the blind interior may be adjusted by sliding the assembly frame through the frame receivers.

Figure 12:
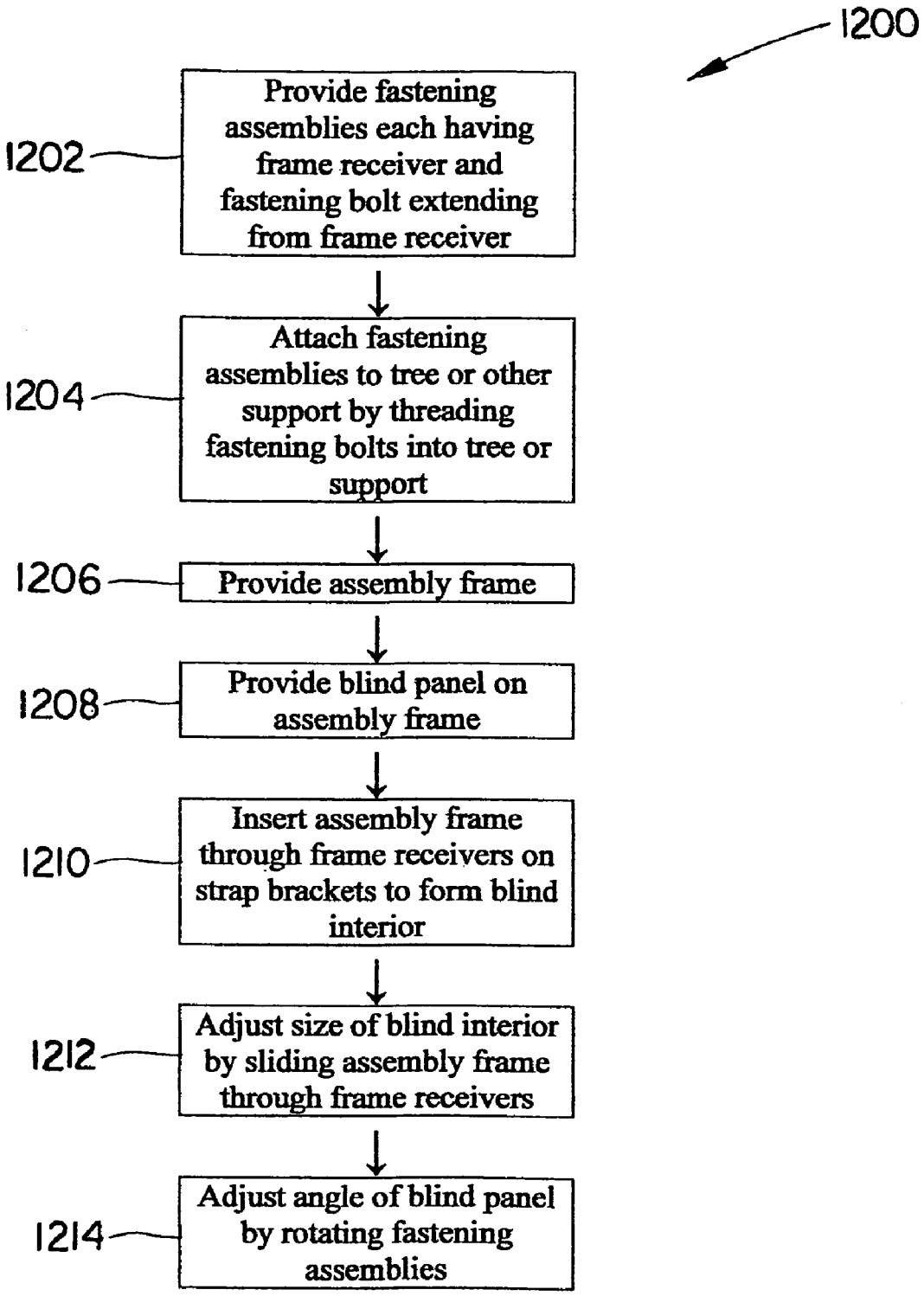
FIG. 12 is a flow diagram of an alternative illustrative embodiment of a method of assembling a blind assembly.

Referring next to FIG. 12 of the drawings, a flow diagram 1200 of an alternative illustrative embodiment of a method of assembling a blind assembly is illustrated. In block 1202, a pair of fastening assemblies each having a frame receiver and a fastening screw extending from the frame receiver is provided. In block 1204, the fastening assemblies are attached to a tree or other support by threading the fastening screws into the tree or support. In block 1206, an assembly frame is provided. In block 1208, a blind panel is provided on the assembly frame. In block 1210, the assembly frame is inserted through the frame receivers on the strap brackets to form a blind interior. In block 1212, the size of the blind interior may be adjusted by sliding the assembly frame through the frame receivers. In block 1214, the angle of the blind panel may be adjusted by rotating the fastening assemblies.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A blind assembly, comprising:

a fastening assembly having substantially parallel frame receivers;

an assembly frame carried by and disposed in substantially a common plane as said frame receivers of said fastening assembly;

a pair of fastening screws carried by said pair of frame receivers, respectively;

said pair of frame receivers, said pair of fastening screws and said assembly frame disposed in substantially a common plane;

a blind panel carried by said assembly frame; and wherein said substantially parallel frame receivers comprises a pair of generally elongated, tubular frame receivers having a pair of receiver openings, respectively, and wherein said assembly frame is inserted in said pair of receiver openings.

2. The blind assembly of claim 1 further comprising spacers carried by said frame receivers, respectively, and wherein said fastening screws extends through said spacers, respectively.

3. The blind assembly of claim 1 wherein said assembly frame comprises a plurality of interconnected assembly frame segments.

4. The blind assembly of claim 1 further comprising a camouflage pattern on said blind panel.

5. A blind assembly, comprising:

a fastening assembly including:

a pair of substantially elongated, parallel, tubular frame receivers having a pair of receiver openings, respectively; and a pair of fastening screws carried by said pair of frame receivers, respectively;

an assembly frame inserted in said frame receivers of said fastening assembly;

said pair of frame receivers, said pair of fastening screws and said assembly frame disposed in substantially a common plane;

a blind panel carried by said assembly frame; and a blind interior defined by said blind panel and adjustable in size by sliding said assembly frame through said frame receivers of said fastening assembly.

6. The blind assembly of claim 5 further comprising a pair of spacers carried by said pair of fastening screws, respectively, of said fastening assembly.

7. The blind assembly of claim 5 further comprising a support and wherein said pair of fastening screws of said fastening assembly is attached to said support and said blind panel is height adjustable by pivoting said pair of fastening screws with respect to said support.

8. The blind assembly of claim 5 wherein said blind panel has an upper panel edge, a lower panel edge, side panel edges extending between said upper panel edge and said lower panel edge and a frame loop provided in said upper panel edge, and wherein said assembly frame extends through said frame loop.

* * * * *